US009149945B2

(12) United States Patent
Tomassetti et al.

(10) Patent No.: US 9,149,945 B2
(45) Date of Patent: Oct. 6, 2015

(54) RAZOR WITH BLADE HEATING SYSTEM

(71) Applicants: L.P.I. Consumer Products, Inc., Pompano Beach, FL (US); Display Matrix Corporation, Randolph, NJ (US)

(72) Inventors: Louis D. Tomassetti, Pompano Beach, FL (US); William Bohmer, Randolph, NJ (US)

(73) Assignees: L.P.I. Consumer Products, Inc., Pompano Beach, FL (US); Display Matrix Corporation, Randolph, NJ (US)

( * ) Notice: Subject to any disclaimer, the term of this patent is extended or adjusted under 35 U.S.C. 154(b) by 0 days.

(21) Appl. No.: 14/330,705

(22) Filed: Jul. 14, 2014

(65) Prior Publication Data

US 2014/0317933 A1 Oct. 30, 2014

Related U.S. Application Data

(60) Continuation-in-part of application No. 13/417,936, filed on Mar. 12, 2012, now Pat. No. 8,776,378, which is a division of application No. 12/082,840, filed on Apr. 15, 2008, now abandoned.

(51) Int. Cl.
*B26B 21/48* (2006.01)

(52) U.S. Cl.
CPC ..... *B26B 21/48* (2013.01)

(58) Field of Classification Search
CPC ..... B26B 21/48
See application file for complete search history.

(56) References Cited

U.S. PATENT DOCUMENTS

| | | | | |
|---|---|---|---|---|
| 2,231,219 | A * | 2/1941 | Payson | 219/223 |
| 6,817,101 | B1 * | 11/2004 | Bohmer | 30/34.05 |
| 6,836,966 | B2 * | 1/2005 | Patrick | 30/34.05 |
| 7,353,606 | B2 * | 4/2008 | Hudgins | 30/30 |
| 7,743,506 | B2 * | 6/2010 | Szczepanowski et al. | 30/34.05 |
| 8,533,958 | B2 * | 9/2013 | Tomassetti et al. | 30/34.05 |
| 8,661,687 | B2 * | 3/2014 | Rebaudieres et al. | 30/34.05 |
| 8,776,378 | B2 * | 7/2014 | Tomassetti et al. | 30/34.05 |
| 2003/0226258 | A1 * | 12/2003 | Patrick | 30/34.05 |
| 2005/0188540 | A1 * | 9/2005 | Kelly et al. | 30/45 |
| 2006/0037197 | A1 * | 2/2006 | Hawes et al. | 30/45 |
| 2006/0070242 | A1 * | 4/2006 | Szczepanowski et al. | 30/140 |
| 2006/0123631 | A1 * | 6/2006 | Szczepanowski et al. | 30/44 |
| 2009/0255123 | A1 * | 10/2009 | Tomassetti et al. | 30/34.05 |
| 2010/0031510 | A1 * | 2/2010 | Gester et al. | 30/34.05 |
| 2012/0222310 | A1 * | 9/2012 | Tomassetti et al. | 30/34.05 |
| 2012/0227265 | A1 * | 9/2012 | Tomassetti et al. | 30/34.05 |
| 2014/0317933 | A1 * | 10/2014 | Tomassetti et al. | 30/34.05 |

* cited by examiner

*Primary Examiner* — Hwei C Payer
(74) *Attorney, Agent, or Firm* — Robert M. Downey, P.A.

(57) ABSTRACT

A razor having a handle and a blade cartridge containing one or more blades includes an electric circuit with a battery power source for controlled direction of current flow through the one or more blades in order to heat the blades. The electric circuit further includes opposing electrically conductive contact leads, the battery power source, and an electrically conductive contactor in contact with an ON/OFF switch all housed on the blade cartridge. A housing for the battery and switch extends transversely in spaced and separated relation to the blades and defines a bridge structure over an open gap between the housing and the blades for allowing a directed stream of water flow to pass below the housing, through the gap and between the plurality of electrically conductive blades for rinsing debris from surfaces of the blades.

10 Claims, 3 Drawing Sheets

RAZOR WITH BLADE HEATING SYSTEM

This application is a Continuation-in-Part (CIP) of Divisional application Ser. No. 13/417,936 filed on Mar. 12, 2012, now U.S. Pat. No. 8,776,378 which is based on non-provisional patent application Ser. No. 12/082,840 filed on Apr. 15, 2008, now abandoned.

BACKGROUND OF THE INVENTION

1. Field of the Invention

The present invention relates generally to razors for shaving and, more particularly, to a battery powered system in a razor for heating of one or more blades of the razor.

2. Discussion of the Related Art

It is well known that hairs are softened and easier to cut when they are heated just prior to being cut by the sharp cutting edge of a razor blade. It is also known that the cutting edge of the razor blade is more effective in cutting hairs when the blade is warm or hot. Just prior to shaving, most people warm the hairs and skin with hot water or a hot towel. It is also common practice to place the shaver under hot running water in order to heat the blades just prior to stroking the blades over the skin in order to cut the hairs. However, the heat cutting performance of the blades lasts only a short time during the beginning of the shaving stroke. Within seconds, the temperature of the skin surface, hairs and blade are quickly reduced due to exposure to the ambient air temperature. Ideally, it is best to maintain the blades warm or hot throughout the shaving process.

The present invention provides for a heat controller for allowing the user to selectively adjust the heated temperature of the blades for desired comfort and optimum blade cutting efficiency. A further improvement provides for a total "onboard" heating system in a disposable blade cartridge, inclusive of an on/off switch, thereby providing for controlled heating of blades in disposable blade cartridges for use on conventional razor handles. A further improvement which may be provided by the present invention is an automatic turn-off switch, in addition to the user controlled on/off switch, for automatically turning the heating system off after use of the razor in the event the user fails to operate the on/off switch, thereby preserving battery life.

SUMMARY OF THE INVENTION

In a razor having a handle and a blade cartridge containing one or more blades, a system is provided for heating the blades. The blade heating system includes an electric circuit with a battery power source for controlled direction of current flow through the one or more blades in order to heat the blades. The electric circuit further includes opposing electrically conductive contact leads and, the battery power source, and an electrically conductive sliding contactor in contact with an ON/OFF switch. All of the components of the blade heating system, including the ON/OFF switch and battery power source, are housed on the disposable blade cartridge. An automatic turn off switch may be included for opening the circuit after a predetermined period of time has elapsed in order to preserve battery life.

Objects and Advantages of the Invention

Considering the foregoing, it is a primary object of the present invention to provide a blade heating system in a razor that allows for controlled heating of one or more blades in the blade cartridge of the razor.

It is still a further object of the present invention to provide a blade heating system for a razor that is contained entirely within a disposable blade cartridge.

It is still a further object of the present invention to provide a heating system in a razor for heating one or more blades in the blade cartridge of the razor and including a switch on the disposable blade cartridge for activating and deactivating the heating system.

These and other objects and advantages of the present invention are more readily apparent with reference to the following detailed description and the accompanying drawings.

BRIEF DESCRIPTION OF THE DRAWINGS

For a fuller understanding of the nature of the present invention, reference should be made to the following detailed description taken in conjunction with the accompanying drawings in which.

Like reference numerals refer to like parts throughout the several views of the drawings.

DETAILED DESCRIPTION OF THE PREFERRED EMBODIMENTS

Figure 1B:
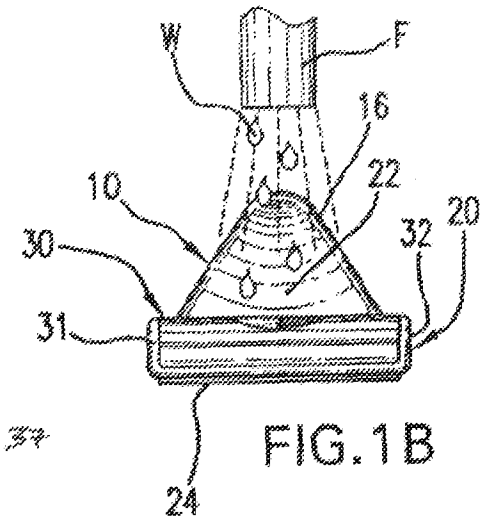
FIG. 1B is a front elevational view showing the blade cartridge of FIG. 1 with running water from a faucet being directed onto the concave scoop for flushing debris from the blades.
Figure 1A:
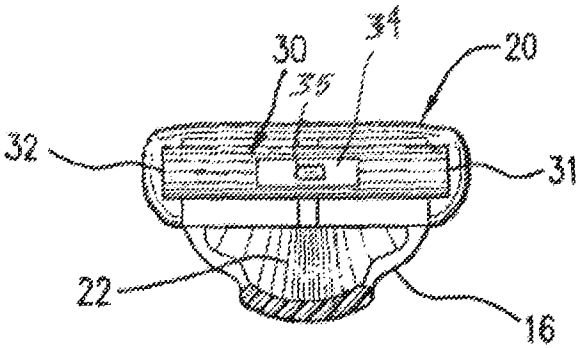
FIG. 1A is an isolated top plan view, taken along the plane of the line 1A-1A in FIG. 1, showing the blade cartridge with the onboard heating system and a concave scoop formation at the top end of the handle.
Figure 1:
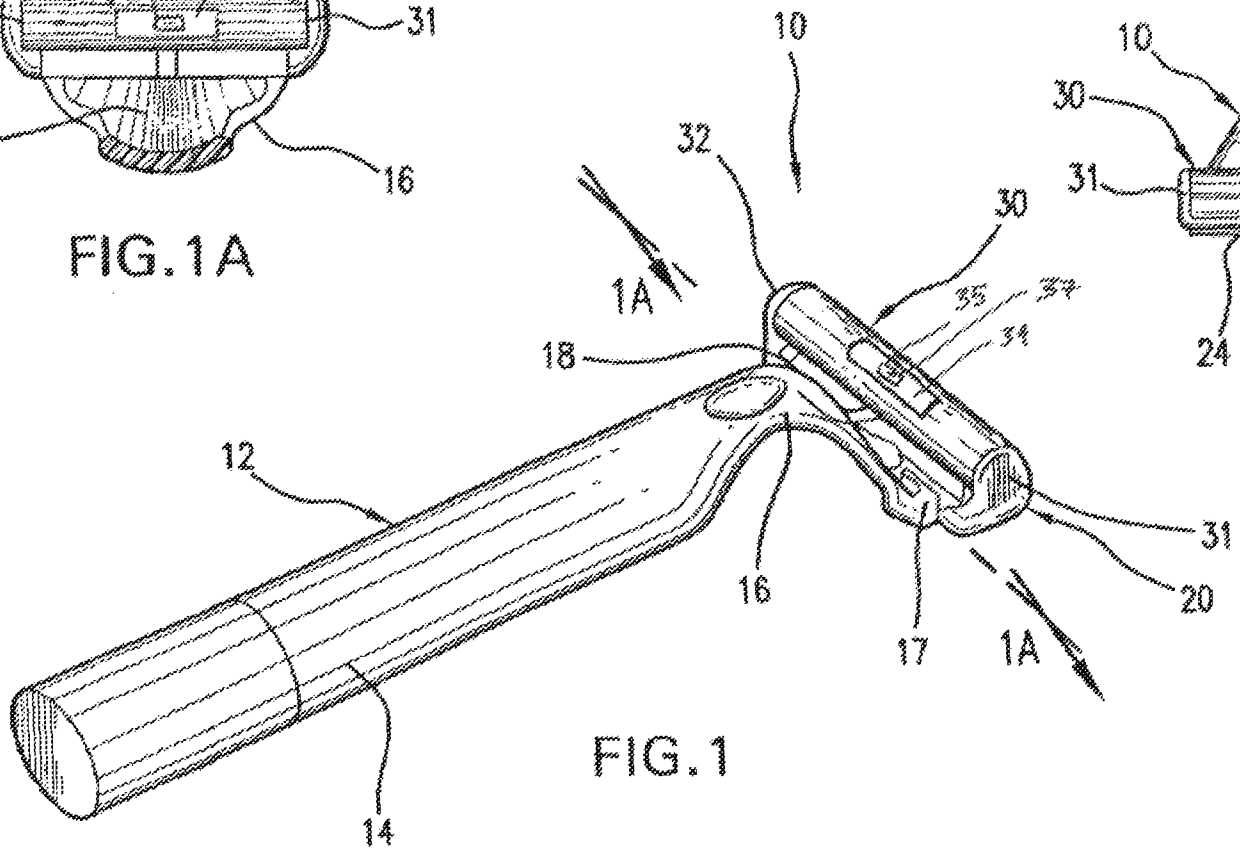
FIG. 1 is a top perspective view of the present invention including a disposable blade cartridge with an onboard blade heating system and a razor handle connected to the blade cartridge.

Referring initially to FIGS. 1-1B, the razor with a blade heating system is shown and is generally indicated as 10. The razor 10 includes a handle 12 with an elongate grasping portion 14 and an integral neck 16. The neck is provided with connecting members 17, 18 on opposite sides for pivotal connection to a blade cartridge 20. The blade cartridge 20 may be affixed to the handle in a manner wherein the entire razor 10 is disposed of after several uses for shaving. Alternatively, the blade cartridge 20 may be removably attachable to the connecting members 17, 18 of the neck 16 wherein the blade cartridge is separated from the handle 12 and discarded after several uses when the blades begin to dull. Thereafter, a new blade cartridge 20 can be attached to the handle 12.

The handle 12 may contain a pressurized charge of shave cream or gel for dispensing in a manner similar to that disclosed in U.S. Pat. Nos. 7,051,439 and 7,814,661 to Tomassetti. Alternatively, the handle 12 may be of any conventional type that is well known in the razor industry or a newly designed handle, such as an ergonomically shaped handle that may contain shave cream or gel for dispensing therefrom.

In a preferred embodiment, the handle 12 of the razor 10 in the embodiment of FIGS. 1-1B is specifically designed to include a concave top surface 22 on the neck portion extending towards the blade cartridge 20. This concave top surface 22, defining a scoop or channel, is specifically structured and configured for directing a stream of water flow through the blade cartridge 20, below a battery housing, and between the blades 24, to thereby rinse debris (e.g., cut hairs, shaving cream, skin particles, etc.) from the blade surfaces. As seen in FIG. 1B, rinsing of the blades 24 can be achieved by holding the blade cartridge 20 and, more particularly, the concave top surface 22 of the neck below a running stream of water from a faucet. The stream of water from the faucet strikes the concave top surface 22 and flows, in a highly directional stream, through the blade cartridge 20 and between the blades 24.

The onboard heating system is contained within a water-tight housing 30 on the blade cartridge 20, defining a bridge structure extending over the blades 24. As seen in FIGS. 1-1B, the water-tight housing 30 includes a transverse structure, extending substantially across the length of the blade cartridge, from a right end to a left end. The transverse structure may be cylindrical, as shown, and is integrally molded or attached to opposite end walls 31, 32, at the right and left ends of the blade cartridge 20. The transverse water-tight housing structure 30 contains a battery power source 38 for providing electric current flow through the circuit of the blade heating system, and particularly through the blades 24 in the blade cartridge. In the preferred embodiment, at least one control is provided on the water-tight housing 30 and includes an ON/OFF switch 34. In one embodiment, the ON/OFF switch 34 is a slide switch, as shown in FIGS. 1 and 1A. A raised projection 35 on the top side of ON/OFF switch 34 may be provided to assist a user in operating the switch 34 between the ON and OFF positions. The raised projection 35 may include a light indicator 37 (e.g., LED indicator) for visually displaying to the user that the blade heating system is activated. The LED indicator 37 may alternatively be located elsewhere on the body of the housing 30.

Figure 2:
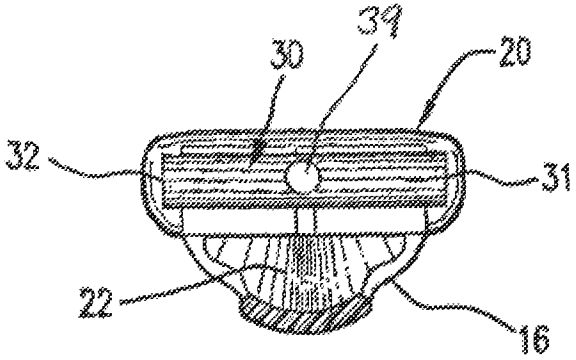
FIG. 2 is an isolated top plan view showing an alternative embodiment of the blade cartridge with the onboard heating system and a concave scoop formation at the top end of the handle.

Referring to FIG. 2, an alternative embodiment of the ON/OFF switch 34 is shown wherein the ON/OFF switch is a push button switch 39. In this embodiment, the push button switch 39 is pressed down by the user to turn on the heating system and subsequently pressed down a second time to turn off the heating system.

Figure 5:
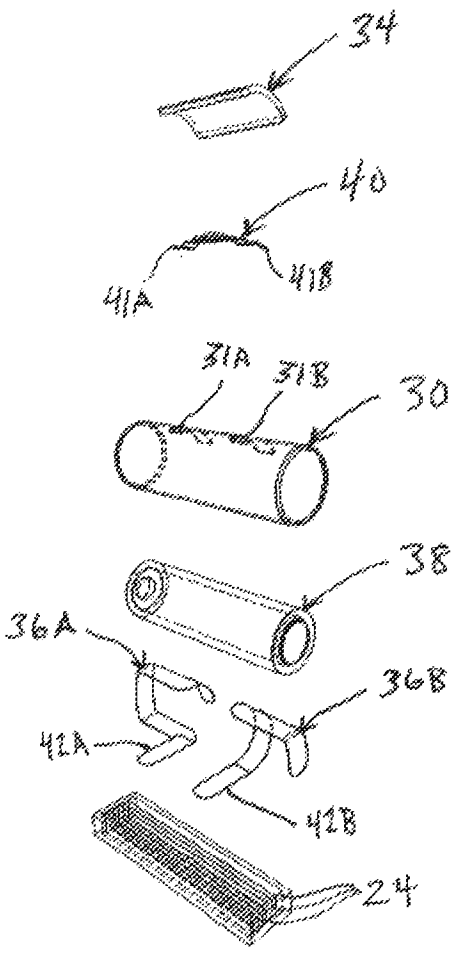
FIG. 5 is an exploded view of the blade cartridge blade heating system components.
Figure 3:
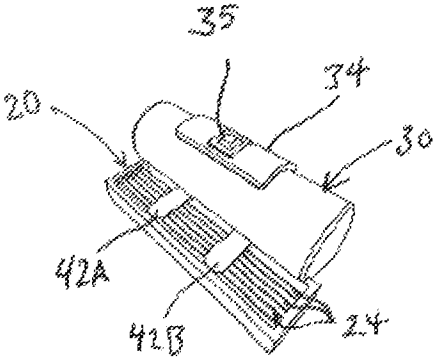
FIG. 3 is a perspective view showing one embodiment of the blade cartridge with onboard heating system.
Figure 4:
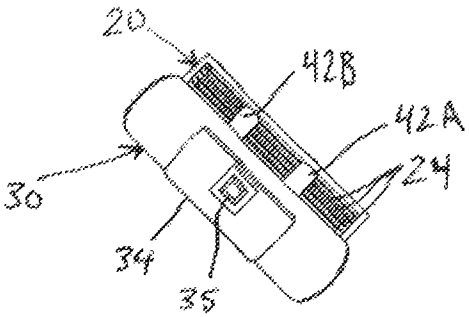
FIG. 4 is a top plan view showing the blade cartridge with onboard heating system from FIG. 3.

Referring to FIGS. 3-5, electric current flow through the blades 24 is achieved by moving the ON/OFF switch 34 to the ON position, which closes the electric circuit between the blades 24, opposing electrically conductive contact leads 36A and 36B, the battery power source 38, and an electrically conductive sliding contactor 40 in connection with ON/OFF switch 34. The sliding contactor 40 is held against ON/OFF switch 34 on the outer surface of the watertight housing 30 and includes oppositely disposed electrically conductive connectors 41A and 41B that pass through openings 31A and 31B on watertight housing 30. The opposing electrically conductive contact leads 36A and 36B are in contact with the positive and negative terminals, respectively, of the battery power source 38 contained within the water-tight housing 30. Electrically conductive blade contacts 42A and 42B extend from contact leads 36A and 36B, respectively, and connect at opposite ends of the blades 24. The conductive blade contacts 42A and 42B may be connected to the blades 24 in parallel or series.

Figure 6:
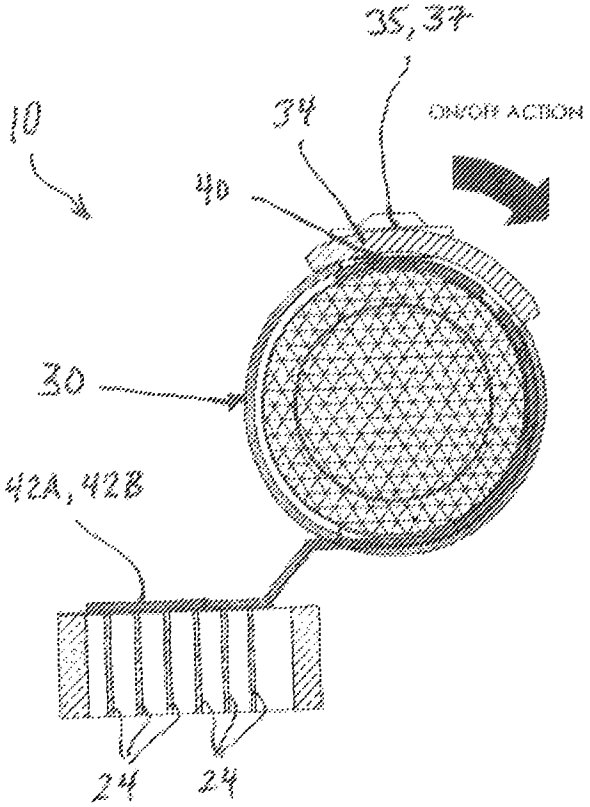
FIG. 6 is a side elevational view, shown in cross-section, illustrating movement of the slide switch for turning the blade heating system on and off.

Referring to FIG. 6, forward movement of the ON/OFF switch 34 from a resting position into the ON position causes each of the opposing connectors 41A and 41B on the sliding contactor 40 to move into contact with the respective one of the opposing contact leads 36A and 36B, thereby closing the electric circuit and causing the blades to be heated. Subsequent backward movement of the ON/OFF switch 34 causes the opposing connectors 41A and 41B to separate from the respective opposing contact leads 36A and 36B, thereby opening the electric circuit. In a preferred embodiment, the ON/OFF switch 34 automatically returns to its resting position when released by the user, wherein subsequent forward movement of the ON/OFF switch 34 causes the opposing connectors 41A and 41B to separate from the respective opposing contact leads 36A and 36B, thereby opening the electric circuit. While operation of the ON/OFF slide switch 34 has thus far been described herein as necessitating forward and backward movement, it is considered that the switch 34 may alternatively be moveable from side to side (e.g., from left to right) for operating the blade heating system.

Figure 7:
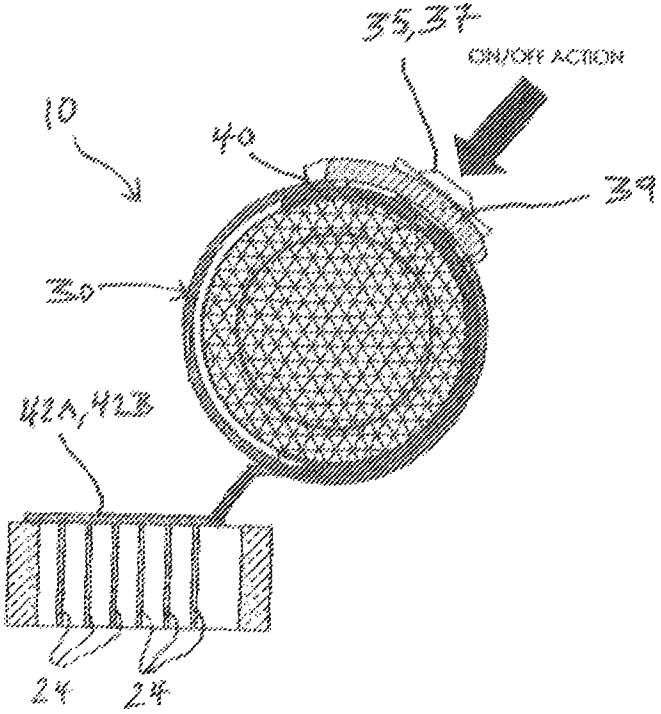
FIG. 7 is a side elevational view, shown in cross-section, illustrating movement of the push button switch for turning the blade heating system on and off.

Referring to FIG. 7, operation of the alternative embodiment of the ON/OFF switch 39 is shown, wherein the ON/OFF switch 39 is pushed inwards from a resting position into the ON position, thereby causing each of the opposing connectors 41A and 41B on moving contactor 40 to move into contact with the respective one of the opposing contact leads 36A and 36B, thereby closing the electric circuit and causing the blades to be heated. Subsequent inward pushing of the ON/OFF switch 39 causes the opposing connectors 41A and 41B to separate from the respective opposing contact leads 36A and 36B, thereby opening the electric circuit.

The blade heating system circuit may further be provided with a timer for opening the circuit, thereby deactivating (i.e., turning off) the blade heating system, in the event the user forgets to turn the blade heating system off by moving the ON/OFF switch 34 on the water-tight housing 30 to the OFF position. In this instance, the circuit will be opened, thereby turning off the blade heating system, after a predetermined period of time has lapsed.

The battery power source 38 may be any suitable battery having any particular size and/or shape. The watertight housing 30 is correspondingly sized and shaped to fit the particular battery power source 38 used to power the onboard heating system.

While the present invention has been shown and described in accordance with several preferred and practical embodiments, it is recognized that departures from the instant disclosure are contemplated within the spirit and scope of the present invention which are not to be limited except as defined in the following claims as interpreted under the Doctrine of Equivalents.

What is claimed is:

1. A blade cartridge for a shaving razor having a handle, the blade cartridge comprising:

a plurality of electrically conductive blades each formed as a unitary body and each being structured and disposed for receiving an electric current flow through said unitary body;

a housing on said blade cartridge and extending transversely in spaced and separated relation to the plurality of electrically conductive blades, and said housing defining a bridge structure over an open gap between said housing and the plurality of electrically conductive blades for allowing a directed stream of water flow to pass below said housing, through the gap and between the plurality of electrically conductive blades for rinsing debris from surfaces of the plurality of electrically conductive blades;

an electric power storage source contained within said housing;

a first electrically conductive contact lead and a second electrically conductive contact lead connecting said electric power storage source to at least one of the plurality of electrically conductive blades for delivering electric current to the at least one of the plurality of electrically conductive blades;

a switch on said housing selectively operable between an ON status for allowing the electric current flow through the at least one of the plurality of electrically conductive blades, and an OFF status for interrupting the electric current flow through the at least one of the plurality of electrically conductive blades;

an electrically conductive contactor held in place by said switch, and said contactor including oppositely disposed electrically conductive connectors located within said housing, and wherein selective operation of said switch into the ON position moves each of said oppositely disposed connectors on said contactor into electrical connection with a respective one of said first and second contact leads, and selective operation of said switch into the OFF position moves each of said oppositely disposed connectors out of electrical connection with said first and second contact leads; and wherein flow of the electric current through the unitary body of the at least one of the plurality of electronically conductive blades causes the at least one of the plurality of electrically conductive blades to be heated.

2. The blade cartridge as recited in claim 1 wherein said switch is a slide switch.

3. The blade cartridge as recited in claim 1 wherein said switch is a push button switch.

4. The blade cartridge as recited in claim 1 further comprising an indicator light for indicating when the switch is in the ON position, and said indicator light being powered by said electric power storage source.

5. The blade cartridge as recited in claim 1 further comprising:

a timer on the blade cartridge for interrupting the electric current flow through the at least one of the plurality of electrically conductive blades after a predetermined amount of time has lapsed.

6. A blade cartridge for a shaving razor having a handle, the blade cartridge comprising:

at least one electrically conductive blade formed as a unitary body and being structured and disposed for receiving an electric current flow through said unitary body;

a housing on said blade cartridge and extending transversely in spaced and separated relation to the at least one electrically conductive blade, and said housing defining a bridge structure over an open gap between said housing and the at least one electrically conductive blade for allowing a directed stream of water flow to pass below said housing, through the gap and the at least electrically conductive blade for rinsing debris from surface of the at least one electrically conductive blade;

an electric power storage source contained within said housing;

a first electrically conductive contact lead and a second electrically conductive contact lead connecting said electric power storage source to the at least one electrically conductive blade for delivering electric current to the at least one electrically conductive blade;

a switch on said housing selectively operable between an ON status for allowing the electric current flow through the at least one electrically conductive blade, and an OFF status for interrupting the electric current flow through the at least one electrically conductive blade;

an electrically conductive moving contactor that is held in place by said switch, and said moving contactor including oppositely disposed electrically conductive connectors located within said housing through respective first and second openings on said housing, and wherein selective operation of said switch into the ON position moves each of said oppositely disposed connectors on said moving contactor into electrical connection with a respective one of said first and second contact leads, and selective operation of said switch into the OFF position moves each of said oppositely disposed connectors on said moving contactor out of electrical connection with said first and second contact leads; and wherein flow of the electric current through the unitary body of the at least one electronically conductive blade causes the at least one electrically conductive blade to be heated.

7. The blade cartridge as recited in claim 6 wherein said switch is a slide switch.

8. The blade cartridge as recited in claim 6 wherein said switch is a push button switch.

9. The blade cartridge as recited in claim 6 further comprising an indicator light for indicating when the switch is in the ON position, and said indicator light being powered by said electric power storage source.

10. The blade cartridge as recited in claim 6 further comprising:

a timer on the blade cartridge for interrupting the electric current flow through the at least electrically conductive blade after a predetermined amount of time has lapsed.

* * * * *